US007179068B2

(12) United States Patent
Makino et al.

(10) Patent No.: US 7,179,068 B2
(45) Date of Patent: Feb. 20, 2007

(54) ELECTRIC COMPRESSOR

(75) Inventors: Masahiko Makino, Shiga (JP); Nobuaki Ogawa, Shiga (JP); Yukihiro Fujiwara, Shiga (JP)

(73) Assignee: Matsushita Electric Industrial Co. Ltd., Kadoma (JP)

( * ) Notice: Subject to any disclaimer, the term of this patent is extended or adjusted under 35 U.S.C. 154(b) by 201 days.

(21) Appl. No.: 11/010,452

(22) Filed: Dec. 14, 2004

(65) Prior Publication Data

US 2005/0129557 A1 Jun. 16, 2005

(30) Foreign Application Priority Data

Dec. 15, 2003 (JP) ..... 2003-416200

(51) Int. Cl.
*F03C 2/00* (2006.01)
*F04C 18/00* (2006.01)

(52) U.S. Cl. ..... 418/55.4; 418/55.1; 418/101; 418/152; 418/179; 417/410.1; 417/410.5

(58) Field of Classification Search ..... 418/55.1, 418/55.4, 55.6, 83, 85, 86, 101, 112, 140, 418/149, 152, 179; 417/410.5, 366, 410.1, 417/423.1

See application file for complete search history.

(56) References Cited

U.S. PATENT DOCUMENTS

| | | | | |
|---|---|---|---|---|
| 6,511,295 | B2 * | 1/2003 | Suitou et al. | 417/410.1 |
| 6,808,372 | B2 * | 10/2004 | Makino et al. | 417/410.5 |
| 2002/0136653 | A1 * | 9/2002 | Gennami et al. | 418/55.6 |
| 2004/0109772 | A1 * | 6/2004 | Ogawa et al. | 417/410.5 |

FOREIGN PATENT DOCUMENTS

| | | | |
|---|---|---|---|
| JP | 04080554 | A * | 3/1992 |
| JP | 2000255252 | A * | 9/2000 |
| JP | 2002364536 | A * | 12/2002 |

* cited by examiner

*Primary Examiner*—Theresa Trieu
(74) *Attorney, Agent, or Firm*—Armstrong, Kratz, Quintos, Hanson & Brooks, LLP

(57) ABSTRACT

A cooling space in an inverter case is disposed at a position opposed to a stationary scroll of a scroll compressor. A refrigerant having low temperature is allowed to flow in and out between the cooling space and the stationary scroll through a seal, thereby cooling an inverter.

9 Claims, 2 Drawing Sheets

ELECTRIC COMPRESSOR

TECHNICAL FIELD

The present invention relates to an electric compressor comprising a scroll compression mechanism, an electric motor for driving the scroll compression mechanism, an inverter for driving the electric motor, an inverter case for accommodating the inverter, a cooling space for cooling the inverter in the inverter case, an inflow hole through which an intake refrigerant is allowed to flow into the cooling space, and an outflow hole through which the intake refrigerant is allowed to flow out from the cooling space.

BACKGROUND TECHNIQUE

As a conventional electric compressor using an electric motor as a driving source, there is one in which an inverter which controls the electric motor is cooled by using a low temperature refrigerant of a compressor.

According to this structure, the inverter is opposed to a low pressure portion of a body container, the inverter is cooled by an intake refrigerant of the low pressure portion, and the refrigerant which cooled the inverter is introduced into a compression mechanism through a passage which brings the low pressure portion and the body container into communication with each other (e.g., Japanese Patent Application Laid-open No.2002-364536.

However, the conventional structure has problems that the low pressure portion and the refrigerant passage constituent parts must be provided separately, the compressor is increased in size, the number of parts is increased and the compressor becomes expensive.

The present invention has been accomplished to solve such conventional problems, and it is an object of the invention to provide an electric compressor capable of reducing the compressor in size without increasing the number of parts thereof when the inverter is to be cooled by a refrigerant.

To solve the conventional problems, according to the electric compressor of the invention, a cooling space in an inverter case is disposed at a position opposed to a stationary scroll of a scroll compressor. A refrigerant having low temperature is allowed to flow in and out between the cooling space and the stationary scroll through a seal, thereby cooling an inverter.

With this structure, it is unnecessary to provide a new refrigerant passage constituent part between the compression mechanism and the inverter case, and the number of parts can be reduced. Further, since the intake refrigerant passage is formed in a wasted space in the stationary scroll, the compressor can be reduced in size and weight.

DISCLOSURE OF THE INVENTION

A first aspect of the present invention provides an electric compressor comprising a scroll compression mechanism which sucks, compresses and discharges a fluid, an electric motor which drives the scroll compression mechanism, an inverter which drives the electric motor, and an inverter case which accommodates the inverter, a cooling space for cooling the inverter in the inverter case, an inflow hole through which an intake refrigerant is allowed to flow into the cooling space, and an outflow hole through which the intake refrigerant is allowed to flow out from the cooling space, wherein the inflow hole is connected to an outflow port provided in an outer peripheral surface of a stationary scroll of the scroll compression mechanism through sealing means, and the outflow hole is connected to an inflow port provided in the outer peripheral surface of the stationary scroll through sealing means. With this structure, it is unnecessary to provide a new refrigerant passage constituent part between the compression mechanism and the inverter case, and the number of parts can be reduced. Further, since the intake refrigerant passage is formed in a wasted space in the stationary scroll, the compressor can be reduced in size and weight.

According to a second aspect of the invention, in the electric compressor of the first aspect, the outflow port provided in the outer peripheral surface of the stationary scroll is in communication with an intake refrigerant pipe mounting port through the outflow passage provided in the stationary scroll. By providing the outflow passage in the wasted space in the stationary scroll, the compressor can be reduced in size and weight.

According to a third aspect of the invention, in the electric compressor of the first aspect, the inflow port provided in the outer peripheral surface of the stationary scroll is in communication with the scroll compression mechanism through the inflow passage provided in the stationary scroll. Since the wasted space in the stationary scroll is utilized, the compressor can be reduced in size and weight.

According to a fourth aspect of the invention, in the electric compressor of the first aspect, the outflow passage and the inflow passage are in communication with each other through a bypass passage provided in the stationary scroll. A portion of the intake refrigerant flowing into the cooling space is used for cooling the inverter and thus, compression loss caused by the absorbed heat can be reduced, and the performance of the compressor can be enhanced.

According to a fifth aspect of the invention, in the electric compressor of the first aspect, a fin which rectifies a refrigerant is provided in the cooling space. Since the refrigerant which flowed into the cooling space can smoothly be introduced into the outflow hole, the resistance of the passage can be reduced, the cooling efficiency can be enhanced, and the performance of the compressor can be enhanced.

According to a sixth aspect of the invention, in the electric compressor of the first aspect, a slight gap is provided between the cooling space and the stationary scroll which is opposed to the cooling space. Even if the temperature of the compressor is increased to a high value due to heat caused by the compressing operation of the refrigerant or heat caused by driving the electric motor, it is possible to prevent the heat from transferring from the body container to the inverter case due to the thermal insulation by means of the gap, the cooling operation of the inverter is enhanced, and the durability of the compressor is enhanced.

According to a seventh aspect of the invention, in the electric compressor of the first aspect, the inverter case and the stationary scroll are made of the same aluminum. With this, it is possible to prevent leakage from a joint portion caused by distortion generated by thermal expansion, and the reliability can be enhanced.

According to an eighth aspect of the invention, in the electric compressor of the first aspect, the sealing means is provided on a flat portion of the outer peripheral surface of the stationary scroll. With this structure, the adverse thermal influence from the inverter can be reduced.

According to a ninth aspect of the invention, in the electric compressor of the first aspect, the sealing means is made of rubber. Thus, it is possible to seal reliably.

DETAILED DESCRIPTION OF PREFERRED EMBODIMENT

An embodiment of the present invention will be explained with reference to the drawings. It should be understood that the invention is not limited to the embodiments.

Figure 1:
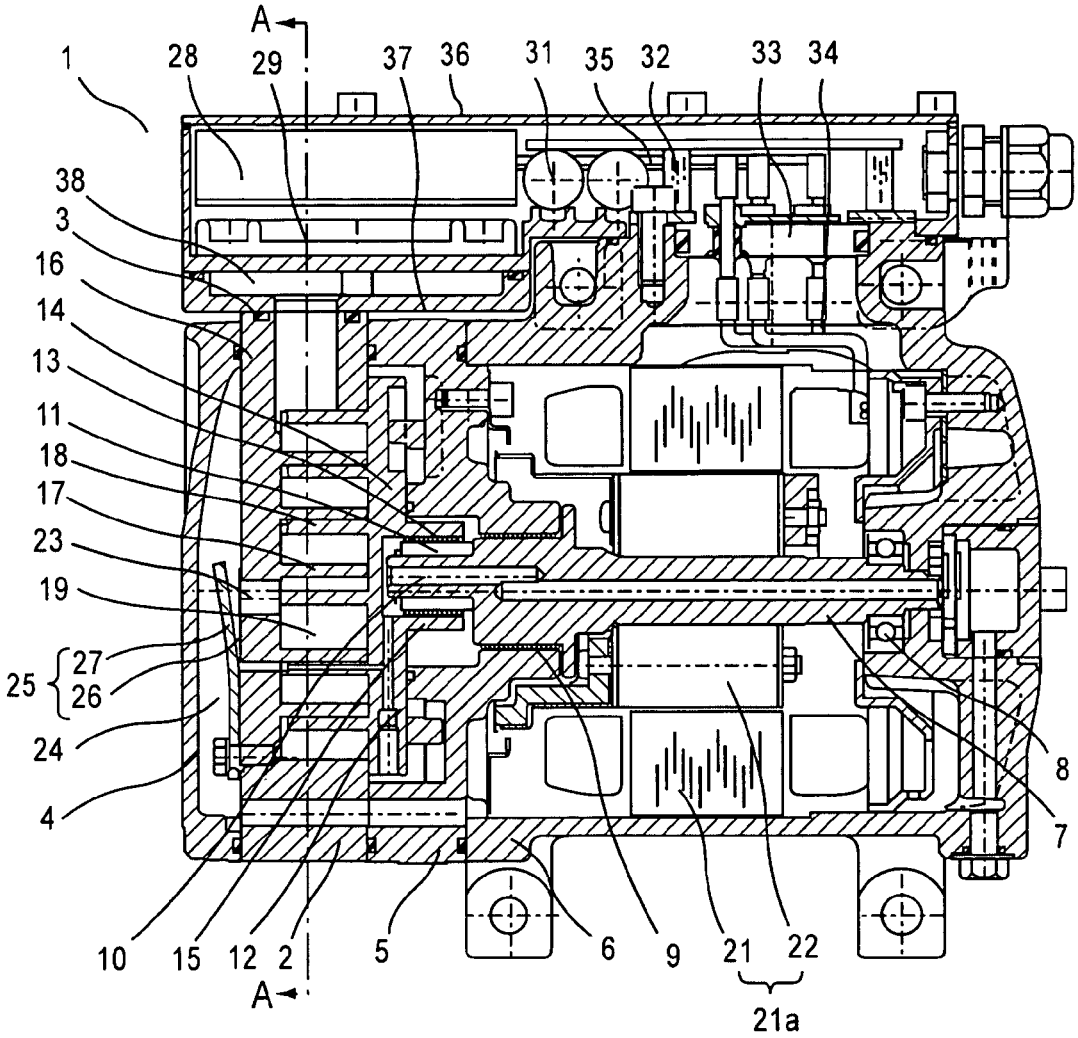
FIG. 1 is a sectional view of an electric compressor showing an embodiment 1 of the present invention.

FIG. 1 is a sectional view of the electric compressor of the embodiment of the invention. As shown in FIG. 1, one end surface of a stationary scroll 2 is joined to an end surface of a cover 4, one end surface of a bearing 5 is joined to the other end surface of the stationary scroll 2, and an end surface of a body container 6 is joined to the other end surface of the bearing 5. The stationary scroll 2, the cover 4, the bearing 5 and the body container 6 constitute an outline of a compressor 1.

A drive shaft 7 is rotatably supported by the bearing 5 and the body container 6 through a ball bearing 8 and a slide bush 13. An eccentric shaft 10 is integrally formed on the drive shaft 7 at an eccentric position from an axis of the drive shaft 7. A bush 11 is provided around the eccentric shaft 10 such that the bush 11 rotates together with the eccentric shaft 10. The bush 11 is fitted into a movable scroll 12 through a slide bush 13. The movable scroll 12 is opposed to the stationary scroll 2.

The movable scroll 12 is provided with a movable spiral wall 18 projecting from one surface of a movable scroll substrate 14 and a cylindrical boss 15 projecting from the other surface of the movable scroll substrate 14. The stationary scroll 2 is provided with a stationary spiral wall 17 projecting from one surface of a stationary scroll substrate 16. The slide bush 13 is accommodated in the cylindrical boss 15 which projects from the back surface of the movable scroll substrate 14. The stationary spiral wall 17 and the movable spiral wall 18 come into contact with each other at a plurality of points. As a result, the stationary scroll substrate 16 and the stationary spiral wall 17 of the stationary scroll 2, and the movable scroll substrate 14 and the movable spiral wall 18 of the movable scroll 12 form a crescent compressing chamber (enclosed space) 19.

A rotation force of the drive shaft 7 is transmitted to the movable scroll 12 by the bush 11 and the slide bush 13. The movable scroll 12 revolves (turning motion) round the stationary scroll 2 as the eccentric shaft 10 rotates (turning motion).

A rotation preventing mechanism (not shown) such as an Oldham ring which prevents the movable scroll 12 from rotating and which allows the movable scroll 12 to move circularly is provided between the bearing 5 and the movable scroll 12. The drive shaft 7 is connected to the movable scroll 12 through the slide bush 3 so that the movable scroll 12 can turn in circular orbit.

That is, when the eccentric shaft 10 rotates, the movable scroll 12 which is relatively rotatably mounted to the eccentric shaft 10 through the slide bush 13 does not rotate but revolves round the center axis of the drive shaft 7.

A stator 21 is fixed to an inner peripheral surface of the body container 6. A rotor 22 is fixed to the drive shaft 7. The stator 21 and the rotor 22 constitute an electric motor 21*a*. If the stator 21 is energized, the rotor 22 and the drive shaft 7 rotate in unison.

As the eccentric shaft 10 of the drive shaft 7 rotates, the movable scroll 12 revolves, and the intake refrigerant introduced from a suction port 20 flows in between the stationary scroll substrate 16 and the movable scroll substrate 14 from aperipheral sides of the both the scrolls 2 and 12.

The intake refrigerant introduced from the suction port 20 flows into a compressing chamber 19. The compressing chamber 19 moves such that the capacity of the compressing chamber 19 is reduced from its outer peripheral side toward its inner peripheral side, and the compressing chamber 19 is converged toward the inner peripheral ends of the spiral walls 17 and 18 of the both the scrolls 2 and 12. A discharge port 23 is formed in a center portion of the stationary scroll substrate 16. The discharge port 23 is in communication with the compressing chamber 19 formed at the innermost peripheral portion.

A discharge chamber 24 is formed on the side of a back surface of the stationary scroll substrate 16. A discharge valve 25 is provided in the discharge chamber 24 for opening and closing the discharge port 23. The discharge valve 25 comprises a reed valve 26 and a retainer 27.

In the electric compressor having the above-described structure, a flat mounting surface 3 is formed on an outer peripheral upper surface in the radial direction of the stationary scroll 2. An inverter case 36 is mounted on the mounting surface 3. The inverter case 36 includes an inverter (inverter control circuit) 28 which controls the electric motor 21*a*.

Constituent parts of the inverter 28 are classified into high temperature generating parts such as a plurality of switching elements 29 which generate high temperature and low temperature generating parts such as a plurality of condensers 31 which are supported by a mounting plate 32 and generate relatively low temperature. These constituent parts of the inverter 28 are accommodated in an inverter case 36.

The switching elements 29 and the electric motor 21*a* in the body container 6 are electrically connected to each other through a compressor terminal 33 and conductive wires 34 and 35. The inverter 28 drives the electric motor 21*a* while monitoring necessary information such as a temperature. Therefore, the inverter 28 is provided with a harness connector (not shown) for electrical connection with respect to outside.

Figure 2:
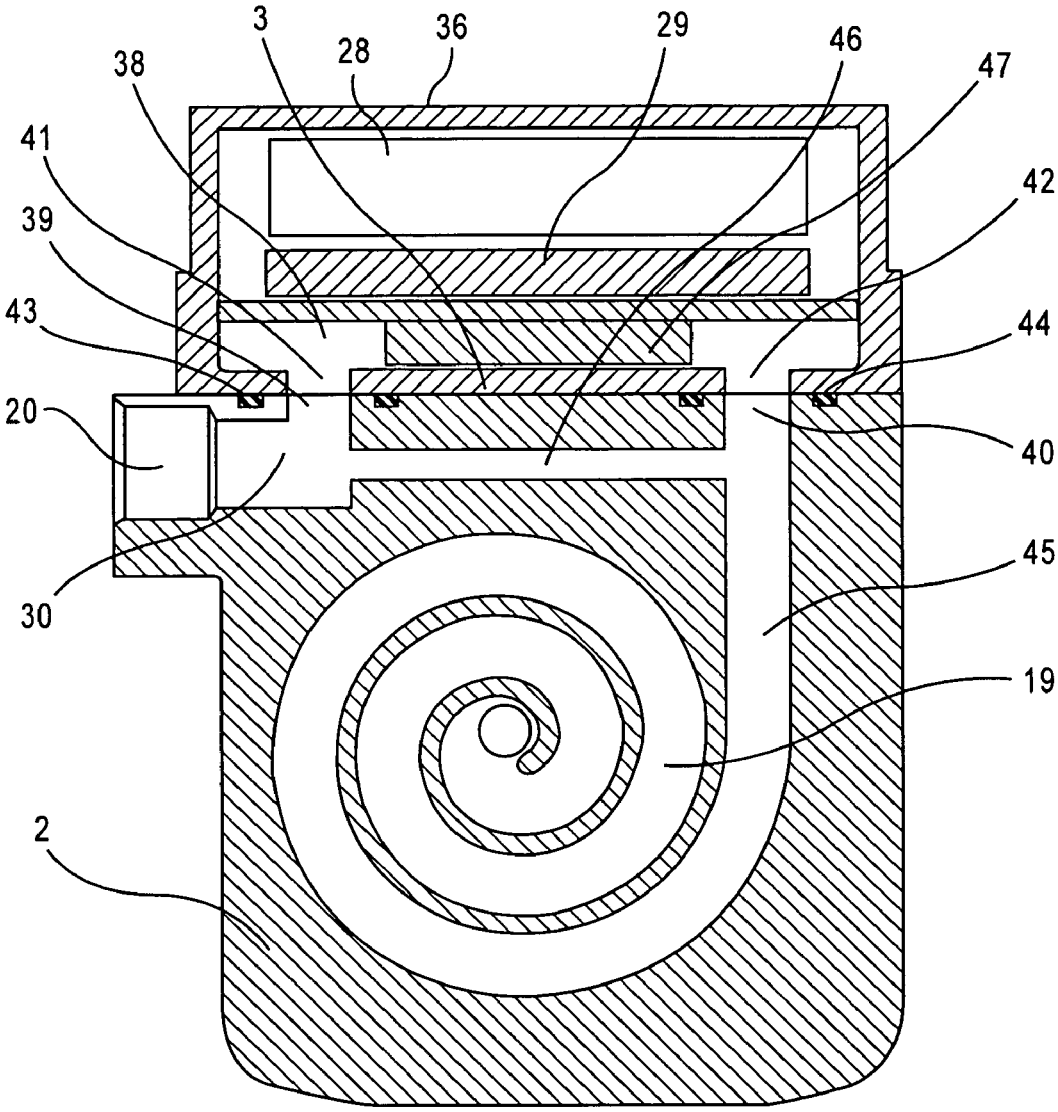
FIG. 2 is a sectional view of the electric compressor taken along the line A—A in FIG. 1 except a movable scroll.

As shown in FIG. 2, the switching elements 29 are disposed above a cooling space 38 defined in the inverter case 36. The cooling space 38 is in contact with the mounting surface 3 in the stationary scroll 2. An outflow port 39 and an inflow port 40 provided in the mounting surface 3 and an inflow hole 41 and an outflow hole 42 provided in the inverter case 36 are connected to each other through seal rings 43 and 44, respectively. The seal rings 43 and 44 are provided on a flat portion (mounting surface 3) of an outer peripheral surface of the stationary scroll 2. Since the mounting surface 3 in the stationary scroll 2 and the inverter case 36 are directly connected to each other through the seal rings 43 and 44 in this manner, the space can be reduced, and it is unnecessary to provide a member which constitutes a refrigerant passage. Further, since the seal rings 43 and 44 are provided on the flat portion which is the mounting surface 3 of the outer peripheral surface of the stationary scroll 2, an adverse influence of heat from the inverter 28 can be reduced. The seal rings 43 and 44 are made of rubber. Since the inverter case 36 and the stationary scroll 2 are made of the same aluminum, it is possible to prevent leakage from a joint portion caused by distortion generated by thermal expansion, and the reliability can be enhanced.

According to the electric compressor of the embodiment having the above-described structure, if the electric motor 21*a* is driven, the movable scroll 12 revolves. With this, the refrigerant is compressed by the compressing chamber 19, and is discharged from the discharge port 23 as high pressure refrigerant. The refrigerant is discharged from the discharge port (not shown) and then, is sent to a condenser (not shown) in an external circuit.

As shown in FIG. 2, the intake refrigerant which returns from an evaporator (not shown) of the external circuit passes through an outflow passage 30 from the suction pipe mounting port 20 and is introduced into the cooling space 38. Then, the intake refrigerant enters the compressing chamber 19 through an inflow passage 45. At that time, the intake refrigerant absorbs heat from the inverter 28 in the inverter case 36, especially from the switching elements 29 so that the inside of the inverter case 36 can be cooled.

In this case, in the embodiment, the inflow passage 45 and the outflow passage 30 are formed using the wasted space in the stationary scroll 2 and thus, the compressor can be reduced in size. Further, of the constituent parts of the inverter 28, the switching elements 29 which generate relatively high temperature are separated from the condensers 31 which generate low temperature, and the switching elements 29 are disposed at upper portions in the cooling space 38. Therefore, the parts which generate high temperature can collectively and efficiently be cooled.

During the operation of the compressor 1, heat is generated by compressing the refrigerant or by driving the electric motor 21*a*. Thus, the temperature of the compressor 1 is increased. Therefore, in this embodiment, the inverter case 36 accommodating the inverter 28 is disposed at a predetermined distance (gap) 37 from the compressor 1 as the temperature generating part. With this structure, this gap 37 forms a heat insulating region comprising air layers, the heat is insulated by this heat insulating region, the radiation heat from the compressor 1 can effectively be blocked, and the cooling effect by the refrigerant is further enhanced.

When the operation of the compressor 1 is stopped, the cooling effect of the inverter 28 by the refrigerant is also stopped. Immediately after the operation of the compressor 1 is stopped, considerable amount of heat is accumulated in the compressor 1. Therefore, when the heat is transmitted to the inverter case 36, there is a possibility that the inverter 28 is abruptly heated to high temperature. However, according to this embodiment, the heat insulating effect against the heat transfer and the radiation heat from the compressor 1 is continued. As a result, the cooling effect of the inverter 28 can be enhanced.

The heat insulating region is formed of the air layers set by the gap 37. Therefore, the structure is simple, and costs thereof are low. This embodiment provides the compressor 1 and a cooling method of the control inverter 28 capable of rationally cooling the compressor 1 not only during the operation of the compressor 1 but also after the operation thereof.

The present invention is not limited to the embodiment, and can appropriately be changed within a range not departing from the subject matter of the invention. For example, although the inverter 28 accommodated in the inverter case 36 is divided into the switching elements 29 which are the high temperature generating parts and the condensers 31 which are the low temperature generating parts in the embodiment, the invention is not limited to this structure. In short, it is only necessary that the cooling space 38 is formed in the vicinity of the temperature generating parts of the inverter 28.

As shown in FIG. 2, if this embodiment is provided with a bypass passage 46 which brings the outflow passage 30 and the inflow passage 45 of the stationary scroll 2 into communication with each other, it is possible to introduce a portion of the intake refrigerant into the compressing chamber 19, and to suppress the intake heat loss. Naturally, the amount of refrigerant flowing into the cooling space is reduced and the cooling efficiency is deteriorated, but if the efficiency of the entire compressor is taken into consideration and the diameter of the bypass passage is optimized, the total cooling efficiency can be enhanced. If a fin 47 is provided in the cooling space 38, the refrigerant which flows from the inflow hole 41 smoothly flows out from the outflow hole 42, and the resistance of the passage can be reduced and the cooling efficiency can be enhanced at the same time.

According to the present invention, the cooling structure of the inverter can be reduced in size and weight without increasing the number of parts thereof.

According to the electric compressor of the invention, it is possible to efficiently cool the inverter utilizing a portion of the compression mechanism. Thus, the electric compressor can directly be mounted on a vehicle having a small engine such as an HEV vehicle. The application of the electric compressor is not limited to the air conditioning, and the electric compressor can be used for refrigeration, and the invention can be applied widely.

What is claimed is:

1. An electric compressor comprising a scroll compression mechanism which sucks, compresses and discharges a fluid, an electric motor which drives said scroll compression mechanism, an inverter which drives said electric motor, and inverter case which accommodates said inverter, a cooling space for cooling said inverter in said inverter case, an inflow hole through which an intake refrigerant is allowed to flow into said cooling space, and an outflow hole through which the intake refrigerant is allowed to flow out from said cooling space, wherein said inflow hole is connected to an outflow port provided in an outer peripheral surface of a stationary scroll of said scroll compression mechanism through sealing means, and said outflow hole is connected to an inflow port provided in said outer peripheral surface of said stationary scroll through sealing means.

2. The electric compressor according to claim 1, wherein said outflow port provided in said outer peripheral surface of said stationary scroll is in communication with an intake refrigerant pipe mounting port through an outflow passage provided in said stationary scroll.

3. The electric compressor according to claim 1, wherein said inflow port provided in said outer peripheral surface of said stationary scroll is in communication with said scroll compression mechanism through said an inflow passage provided in said stationary scroll.

4. The electric compressor according to claim 1, wherein said outflow passage and said inflow passage are in communication with each other through a bypass passage provided in said stationary scroll.

5. The electric compressor according to claim 1, wherein a fin which rectifies a refrigerant is provided in said cooling space.

6. The electric compressor according to claim 1, wherein said inverter case and said stationary scroll have a slight gap at a portion of their regions which face said cooling space.

7. The electric compressor according to claim 1, wherein said inverter case and said stationary scroll are made of the same aluminum.

8. The electric compressor according to claim 1, wherein said sealing means is provided on a flat portion of said outer peripheral surface of said stationary scroll.

9. The electric compressor according to claim 1, wherein said sealing means is made of rubber.

* * * * *